United States Patent [19]

Johnson et al.

[11] Patent Number: 5,033,742

[45] Date of Patent: Jul. 23, 1991

[54] INFLATABLE SIT-UP EXERCISE DEVICE

[75] Inventors: Ronald H. Johnson, Barberton; Craig M. Saunders, Rocky River, both of Ohio

[73] Assignee: Consumer Direct, Inc., Canton, Ohio

[21] Appl. No.: 552,232

[22] Filed: Jul. 12, 1990

[51] Int. Cl.[5] ..... A63B 23/00

[52] U.S. Cl. ..... 272/144; 272/93; 5/455; 5/431; 441/130

[58] Field of Search ..... 272/93, 114, 144; 297/457, 460, DIG. 3; 5/431, 455, 457; 441/42, 66, 125, 126, 127, 129, 130, 132

[56] References Cited

U.S. PATENT DOCUMENTS

| | | | |
|---|---|---|---|
| D. 152,394 | 1/1949 | Ceverha | D83/1 |
| 1,904,039 | 4/1933 | Bruder | 128/69 |
| 2,623,574 | 12/1950 | Damsch | 441/129 X |
| 3,089,153 | 5/1963 | Bosc | 5/455 |
| 3,112,956 | 8/1961 | Schick et al. | 5/455 X |
| 3,611,455 | 10/1971 | Gottfried | 5/348 |
| 4,132,228 | 1/1979 | Green | 128/33 |
| 4,210,322 | 7/1980 | Pritchard | 272/109 |
| 4,230,099 | 10/1980 | Richardson | 128/69 |
| 4,258,952 | 3/1981 | Dutra | 297/258 |
| 4,367,870 | 1/1983 | Birch | 272/144 |
| 4,516,568 | 5/1985 | Baxter et al. | 128/70 |
| 4,534,593 | 8/1985 | Ojala | 297/284 |
| 4,688,283 | 8/1987 | Jacobson et al. | 5/449 |
| 4,723,329 | 2/1988 | Vaccaro | 5/455 |
| 4,759,543 | 7/1988 | Feldman | 272/93 |
| 4,902,003 | 2/1990 | Buoni | 272/93 |

*Primary Examiner*—Richard J. Apley

*Assistant Examiner*—L. Thomas

*Attorney, Agent, or Firm*—Michael Sand Co.

[57] ABSTRACT

An inflatable exercise device for cushioning and supporting the body when used by an exerciser doing sit-up type exercises to stress the exerciser's abdominal muscles. The one-piece device is comprised of at least one hollow inflatable chamber containing a pressurized fluid medium and is formed from a thin flexible resilient plastic material. One portion of said chamber when inflated is generally T-shaped and supports the buttocks, tailbone and lumbar spine areas of the exerciser. The other portion of said chamber when inflated is generally U-shaped and supports the upper and lower back muscles of the exerciser to provide a pelvic tilt effect when the exerciser moves reciprocatably and pivotally between essentially prone and sit-up positions to assist in such pivotal movement. The pressurized hollow chamber of the device maintains the exerciser in longitudinal alignment and out of contact with the device supporting surface, with the user's weight comfortably supported. The hollow chamber has an essentially uninflated hinged portion at the pelvic area to assist in performance of sit-up type exercises. The hollow chamber may be separated into two separate hollow chambers inflated preferably by low-pressure air through two separate valve elements by mouth or pump to support the buttocks, tailbone and spine by one chamber and the back muscled area by the second chamber. While the device is contoured to provide lateral stability to the exerciser, the hands may be placed, if desired, on the floor or device supporting surface to provide increased stability.

14 Claims, 5 Drawing Sheets

FIG-12
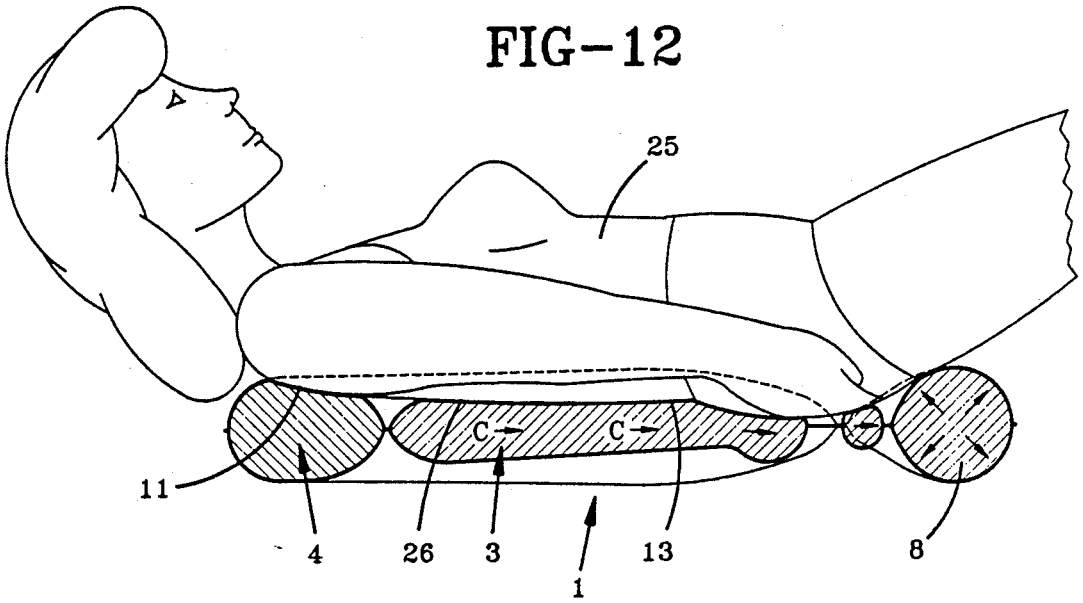
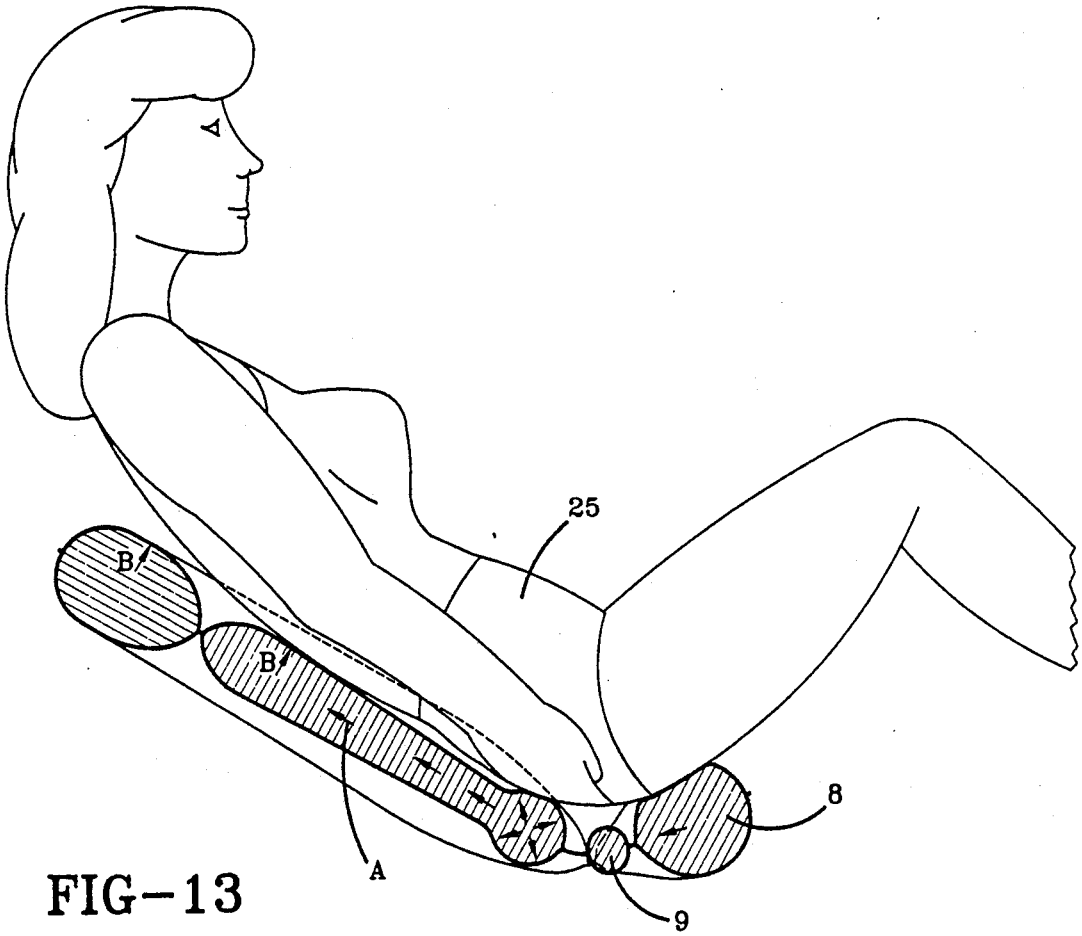
FIG-13

INFLATABLE SIT-UP EXERCISE DEVICE

BACKGROUND OF THE INVENTION

1. Technical Field

This invention relates to an apparatus for use in exercising the abdominal muscles and more particularly, to an inflatable exercise device which is primarily useful for exercising the abdominal muscles of the exerciser by sit-up type exercises.

2. Background Information

A flattened stomach is not only aesthetically desirable, but also indicates that an individual possesses the abdominal strength necessary to avoid some types of low back pain. A flattened stomach is an objective of the most common types of exercise programs to strengthen and decrease the size of the abdominal area to promote good health and fitness. Sit-up type exercises which are also known more properly as the abdominal curl are one of the most common exercises which one can perform to decrease the size and contour of the abdomen. Other related exercises which are designed to strengthen the abdominal muscles are frequently related to the sit-up type exercise, but are frequently more difficult to perform and provide desirable results in decreasing the size and contour of the abdominal area.

While there have been many different types of abdominal exercising devices in the field, a number of such devices produce results which do not necessarily strengthen the abdominal muscles but more powerful hip and thigh muscles which attach to the lumbar spine area and to the rear of the pelvis and hip bones. When such muscles contract not only does the rectus muscle of the abdomen work with little effort but the other muscles rotate the pelvis forward thus creating the occurrence of increased lower back pain which contributes to poor mechanical alignment and undesirable upright posture of the exerciser. Normally, in the performance of conventional sit-up exercises, the feet are projected horizontally or locked under a stationary object to obtain desired leverage. The stronger leg muscles substitute for the abdominal muscles which are not more positively strengthened by the sit-up type exercise. It is preferred that the legs be in a bent position during the sit-up exercise rather than projecting horizontally in locked position.

U.S. Pat. No. 4,752,067 to D. J. Colonello entitled Apparatus For Use In Exercising The Abdominal Muscles relates to a specially shaped rigid exercise device upon which the exerciser lies to perform the exercise wherein the pelvis is cradled in a pelvic basin portion of the device while the lumbar spine is supported by a longitudinal support cushion, the angulation of the interface area between the two body portions being arched convexly to support the anatomical transition between the lower vertebrae of the spine called the sacrum region and the lumbar spine. The rigid solid contoured device of this patent defines a longitudinal axis of symmetry for receiving the buttocks and pelvis of the exerciser, such portion being elliptical in shape with the perimeters smoothly sloping upwardly except for the area of transition of the lumbar support portion. Such device has been marketed under the Trademark, ABDOMENIZER, and being a solid rigid structure having considerable size, cannot be readily transported from place to place for use in different locations, such as while traveling or between several locations in the essentially same locale. While such exercise device has been found to be particularly beneficial to the user, it does not lend itself to comfortably supporting the user while exercising to obtain the same desirable results of abdominal strengthening. While the rocker portion is contoured to fit the lumbar spine area of the user, the widely different back and side configurations of the exerciser must conform to the rigid structure and may or may not be most comfortably supported since no cushioning effect is either directly or indirectly provided to the user by this type of exerciser.

U.S. Pat. No. 4,132,228 to Green discloses a comfort support seat assembly designed to alleviate discomfort of persons who are required to sit for long periods. Such seat cushion is intended to provide even distribution of the gluteal region with pressure relief to assist in alleviating discomfort for long term sedentary positions.

In addition, U.S. Pat. No. 4,230,099 to Richardson and U.S. Pat. No. 4,848,472 to Lindley, both relate to rigid exercise apparatus upon which the exerciser rests one's hips and feet while lying on a flat surface such as a floor while the user oscillates or rotates his body to stretch or relax the back muscles.

U.S. Pat. No. 1,904,039 to Bruder also relates to an essentially rigid body exercising apparatus having elongated ridge members forming a convex curve which substantially corresponds to the natural lumbar curve of the human spine.

None of the aforesaid devices provides significantly distinct comfortable support of the exerciser while performing sit-up type exercises wherein the exerciser is provided with both a pneumatic support of one's body portion out of contact with the underlying supporting surface and wherein a pneumatic tilt effect is automatically provided for upward sit-up assist in performing such exercises.

SUMMARY OF THE INvENTION

It is a basic object of the present invention to provide an improved inflatable sit-up exercise device for use in exercising the abdominal muscles to substantially improve the physiological effectiveness of the commonly utilized sit-up exercise as related to abdominal muscle strength or the normal elastic nature of such living muscles.

In the conventional sit-up exercise, the exerciser lies in the essentially prone face-up position on the floor with the hips and knees flexed approximately 90 degrees and the hands located either behind the head or along the sides. The present invention provides an especially shaped inflated device upon which the subject lies in longitudinal alignment to perform the exercise, the exercising device being located between the subject and the floor in comfortably supported position out of contact with the underlying supporting surface. Provision is made in the device for the pelvic area of the user to be fully supported, with the tailbone and lumbar spine areas in alignment with and supported by the device in suitable recesses provided for their containment in suitable relation. The device may be comprised of a single pressurized hollow chamber or preferably by a pair of pressurized chambers which support the buttocks, tailbone and lumbar spine of the user by one portion of the hollow chamber, and the back and neck muscled areas of the user by another portion of the chamber having greater thickness for more fully supporting the major weight of the user in longitudinal alignment for most comfortable support. The exercise may be continued for longer periods while the user is more comfortably supported. Furthermore, the device may be inflated very readily for use and upon deflation may be easily transported from place to place and readily stored.

The subject exercising device provides a pelvic tilt effect as well as a pneumatic self-induced pneumatic effect upon upward movement of the exerciser upon his upward weight shift of the upper body portion so that the abdominal strengthening is more readily obtainable during the exercise program.

The subject invention relates to an inflatable sit-up exercise device for cushioning and supporting the body when used by the exerciser doing sit-up type exercises to stress the exerciser's abdominal muscles. The one-piece device is comprised of one and preferably two hollow inflatable chambers containing a pressurized fluid medium and is formed from a thin, flexible resilient plastic material. One chamber, when inflated, is generally T-shaped and supports the buttocks, tailbone and lumbar spine areas of the exerciser. The second chamber, when inflated, is generally U-shaped and supports the upper and lower back muscles of the exerciser to provided a pelvic tilt effect when the exerciser moves reciprocatably and pivotally between essentially prone and sit-up positions to assist in such pivotal movement. The exerciser is supported in longitudinal alignment and out of contact with the device supporting surface with virtually all of the user's weight comfortably supported. The hollow chamber has an essentially uninflated hinged portion at the pelvic area in transitional location separated by the two separate hollow chambers, both of which are preferably inflated by low-pressure air through two separate valve elements by either mouth or pump to support the buttocks, tailbone and spine by one chamber, and the bifurcated back muscles on both sides of the spine by the second chamber.

The basin portion of the inflated device includes a buttocks receiving and supporting area to accommodate the buttocks in both the supine recumbent and seated positions. Such area is located adjacent the bony tailbone receiving and supporting area which is recessed and located on the axis of symmetry of the body. The recessed area for the tailbone has an axially-aligned area with the lumbar spine receiving and supporting area which is next adjacent for co-axial support of both body area in their natural condition when both supine and seated. The exerciser's pelvis, tailbone and spine are all naturally aligned with the device for both initiation of the exercises and during their performance. The lowermost recess cradles the exerciser's tailbone and spine, suspending the bony structure of same to reduce both frictional and uncomfortable compressional forces encountered when seated on a rigid exercise apparatus or a hard floor. There is no solid rocker portion to which the user's body must accommodate itself when exercising, the subject device providing a pneumatic cushioning effect for all supported body areas.

BRIEF DESCRIPTION OF THE DRAWINGS

The preferred embodiment of the invention, illustrative of the best mode in which the applicants have contemplated applying the principles, are set forth in the following description and shown in the drawings and are particularly and distinctly pointed out and set forth in the appended claims.

FIGS. 12 and 13 are side elevational diagrammatic views with portions in sections, showing a person doing sit-up exercises illustrating the air flow in different areas of the U-shaped second pressurized chamber assisting the exerciser in performing sit-up type exercises.

Similar numerals refer to similar parts throughout the drawings.

DESCRIPTION OF THE PREFERRED EMBODIMENT

With reference to the drawings, the subject exercising device is indicated generally at 1, and preferably comprises a one-piece inflatable body structure which preferably is formed from two thin sheets of flexible resilient plastic material such as polyvinyl, polyethylene, or other similar material. The sheets preferably are formed into an inflatable unitary body somewhat generally comparable to a plastic air mattress. However, the subject device has an especially contoured configuration to receive and cushion complementally curved areas of the body in especially comfortable relation for both short and long term exercising. The device provides widely varying degrees of flexibility due to its inflatable nature, whereby bony portions are cushioned differently from the heavily muscled areas on the backside of an exerciser. The device may be formed with one or more hollow chambers adapted to be pressurized at low pressure by a fluid medium such as a gas or liquid, which maintains the exerciser's body in a naturally contoured supported position which conforms to the body's natural shape and contours. Both the bony and muscled areas of the body are suitably supported, with the device providing both a pelvic tilt effect and a fluid assisted effect during bodily movement in performing various types of sit-up exercises.

Device 1 essentially comprises two inflatable chambers indicated generally at 3 and 4, which are adapted to contain a low-pressure fluid such as air. Chamber 3 is generally T-shaped when inflated and is adapted to receiving and supporting the buttocks and tailbone and lumbar spine areas of the exerciser in vertical alignment with the device. Chamber 4 has a generally U-shaped configuration and is adapted to surround a portion of the first T-shaped chamber in axial alignment therewith, said second chamber being adapted to retain the upper and lower back muscled areas of the exerciser in both the supine recumbent position, as well as in the upright seated position.

The device further comprises an essentially uninflated pelvic basin portion 5 for supporting the pelvic area between the buttocks and lower back muscled area to provide a pelvic tilt effect when the exerciser moves between prone and upright sitting positions. The tailbone and lumbar spine supporting portions of the lower chamber constitute a so-called basin type of support for maintaining the device in axial alignment with the user's body while supporting essentially all portions of the body in pneumatically supported relation by the several pressurized chambers. The two pressurized chambers cooperate with one another for full body support regardless of the user's physical size and body dimensions.

Figure 1:
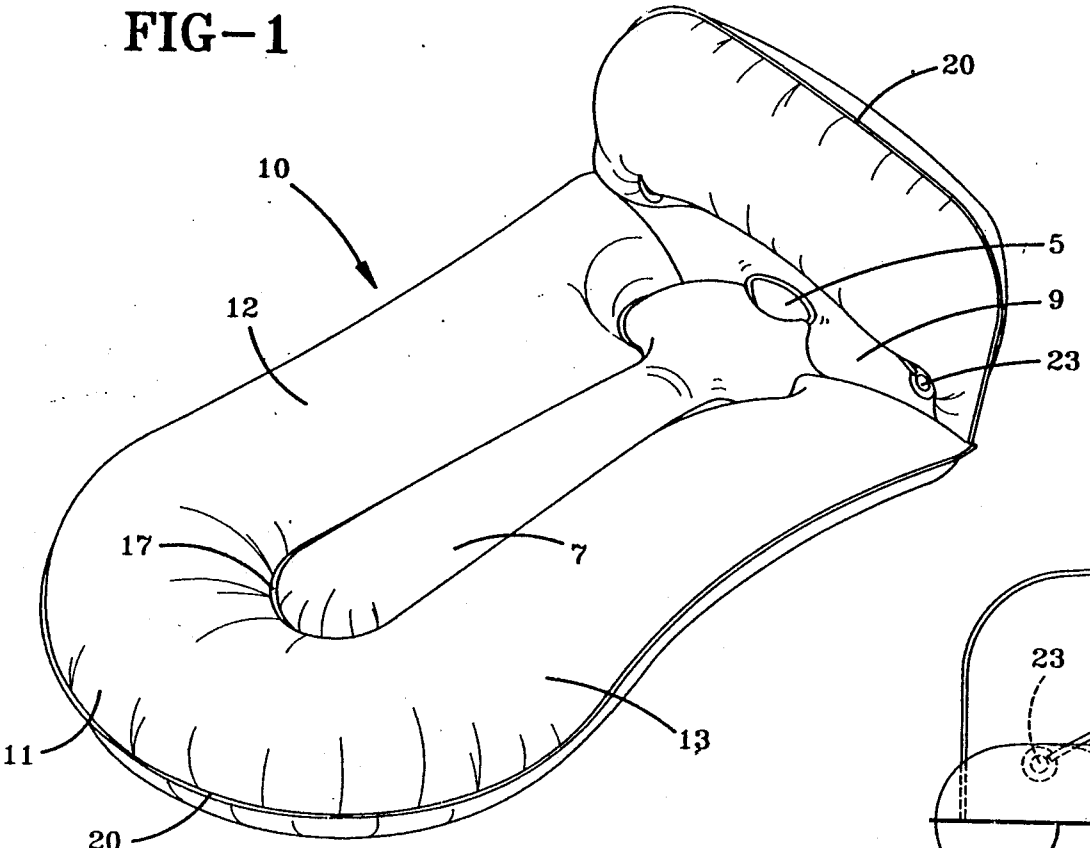
FIG. 1 is a perspective view of the inflatable exerciser in blown-up operative condition.
Figure 4:
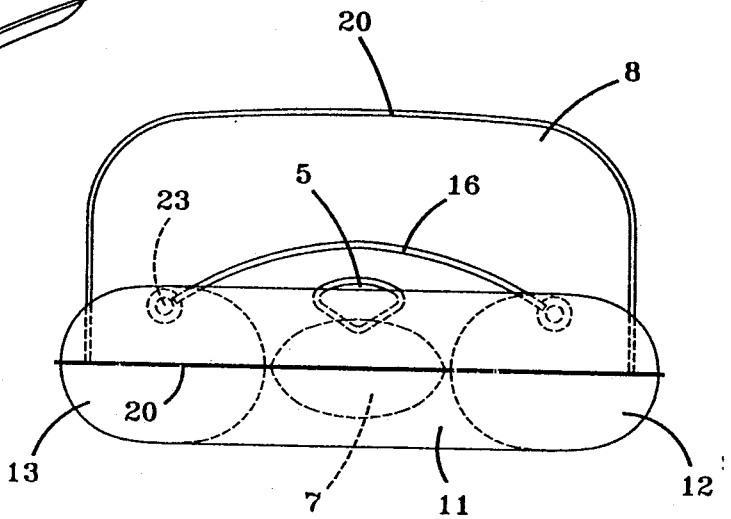
FIG. 4 is a front end elevational view of the device.
Figure 2:
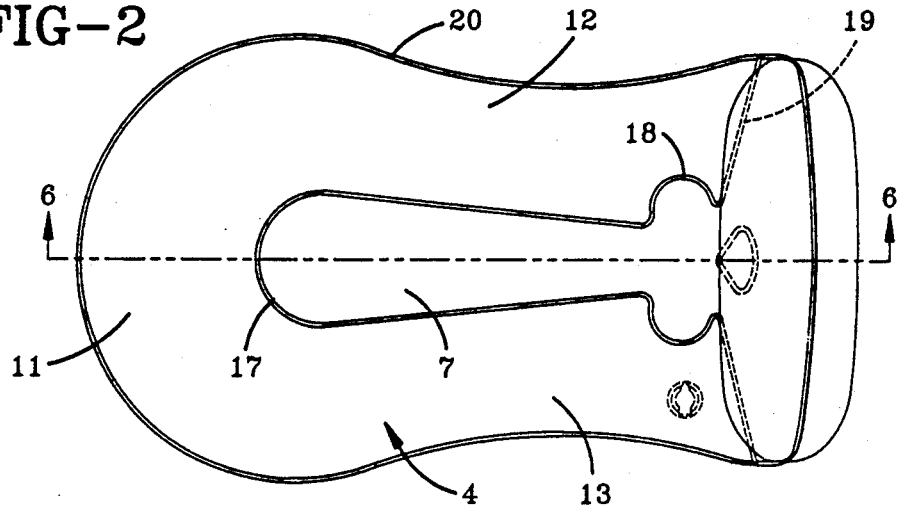
FIG. 2 is a top plan view of the device.
Figure 3:
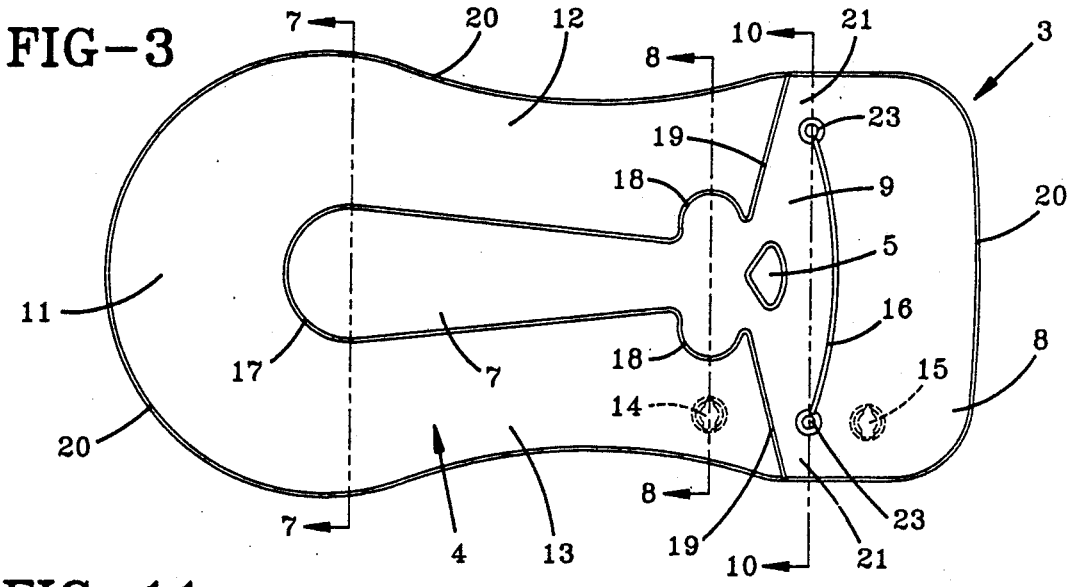
FIG. 3 is a top plan view of the device as shown FIG. 2 but in a more flattened condition.
Figure 6:
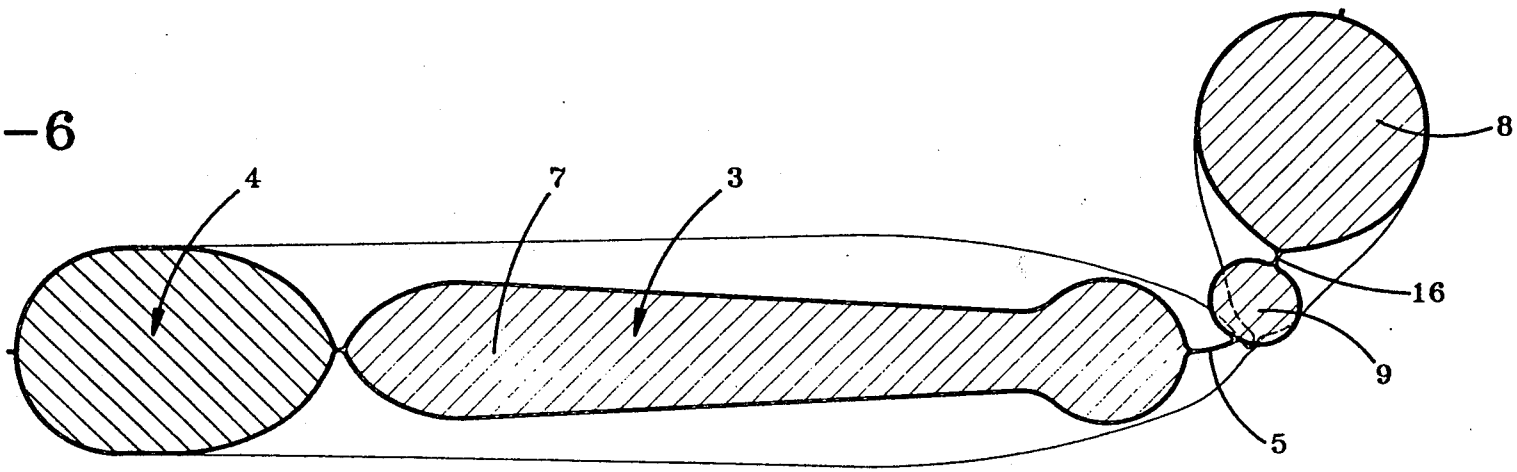
FIG. 6 is a vertical sectional longitudinal view taken through line 6—6 of FIG. 2.
Figure 7:
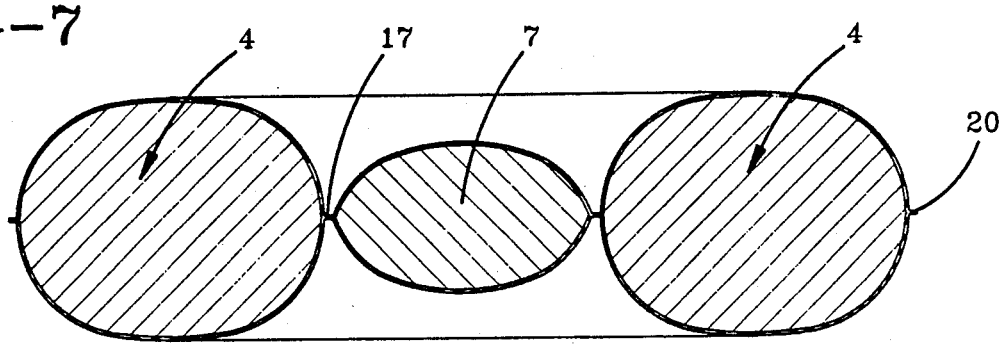
FIG. 7 is a vertical sectional view taken through line 7—7 of FIG. 3.
Figure 10:
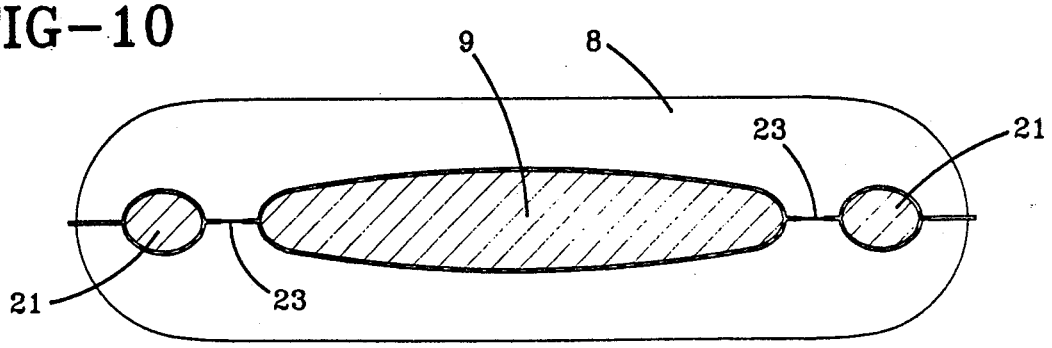
FIG. 10 is a vertical sectional view taken through line 10—10 of FIG. 3.

The first pressurized chamber 3 of the device has a generally T-shaped configuration with the vertical leg portion 7 of such chamber having a lesser thickness than a main cross-over portion 8 (FIG. 6), the former having a lesser thickness for supporting the bony tailbone and lumbar spine areas of the body while the cross-over portion has a greater thickness for supporting the hips and buttocks of the body in comfortable relation. Main cross-over portion 8 is connected to leg portion 7 by an arcuate shaped inflated portion 9 which forms the remaining portion of Chamber 3. Portion 9 is separated from cross-over portion 8 by a curved heat seal portion 16 (FIG. 3) which terminates in circular heat sealed areas 23, but pneumatically communicates with the cross-over portion by a pair of air passages 21 (FIGS. 3 and 10).

The second pressurized chamber 4 has a generally U-shaped configuration which essentially surrounds vertical leg portion 7 of the first chamber to support the bifurcated muscled areas of the upper and lower back regions of the user on opposite sides of the spinal column. Chamber 4 comprises a curved end portion 11 which joins two spaced leg portions 12 and 13 which extend generally axially along leg portion 7 of chamber 3. The two separate pressurized chambers are formed and separated by heat sealing areas of the two sheets of plastic material such as by a heated die member adapted to forming the several chambers when the die is heated and pressed to compressively force the sheet materials together under heat and pressure. Referring particularly to FIG. 3, these heat sealed areas consist of a U-shaped portion 17, two outwardly curved portions 18, and two outwardly extending generally straight areas 19. The two sheets also are joined and sealed along their entire outer peripheries 20 by a heat seal.

An essentially uninflated hinged area of the device having a generally curvilinear configuration, is formed essentially by heat seal areas 19 at the intersection of the T-shaped first chamber and inflated portion 9 to support the pelvic area of the user and to thereby provide a pelvic tilt effect when the inflated device is used by the exerciser in sit-up type exercises. The pelvic support region may be formed in either linear or preferably curvilinear configuration. The buttocks supporting area and tailbone supporting areas of the first chamber being formed with interconnecting open passageways 21 at the extremities of the cross-over portion of the T-shaped chamber. The vertical longer leg member of the T-shaped member has an essentially ball-bat shaped configuration to support the user from essentially the user's waist portion to the upper back. The second U-shaped chamber has a thickness when inflated comparable to the buttocks supporting region of the first chamber for comfortable and body shaped configurations which are self established on the two chambers when the exerciser assumes the initial prone position.

Figure 11:
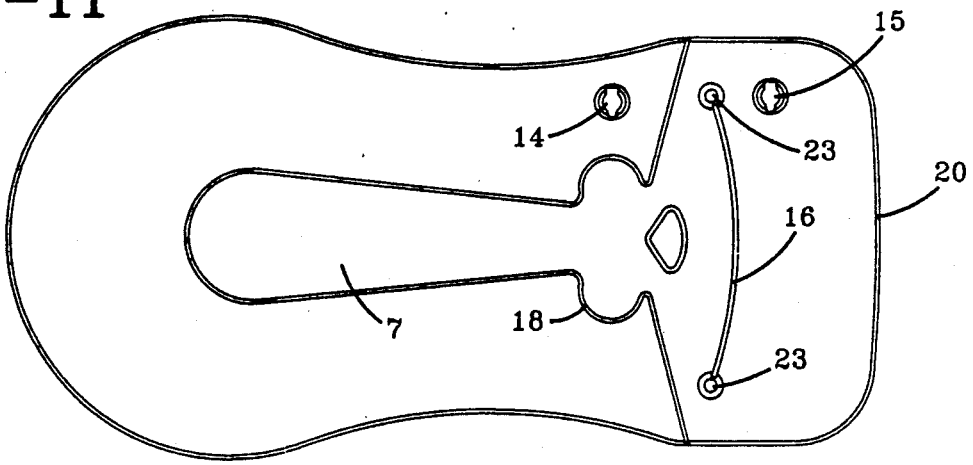
FIG. 11 is bottom plan view of the device in a generally flattened condition as shown in FIG. 3.
Figure 5:
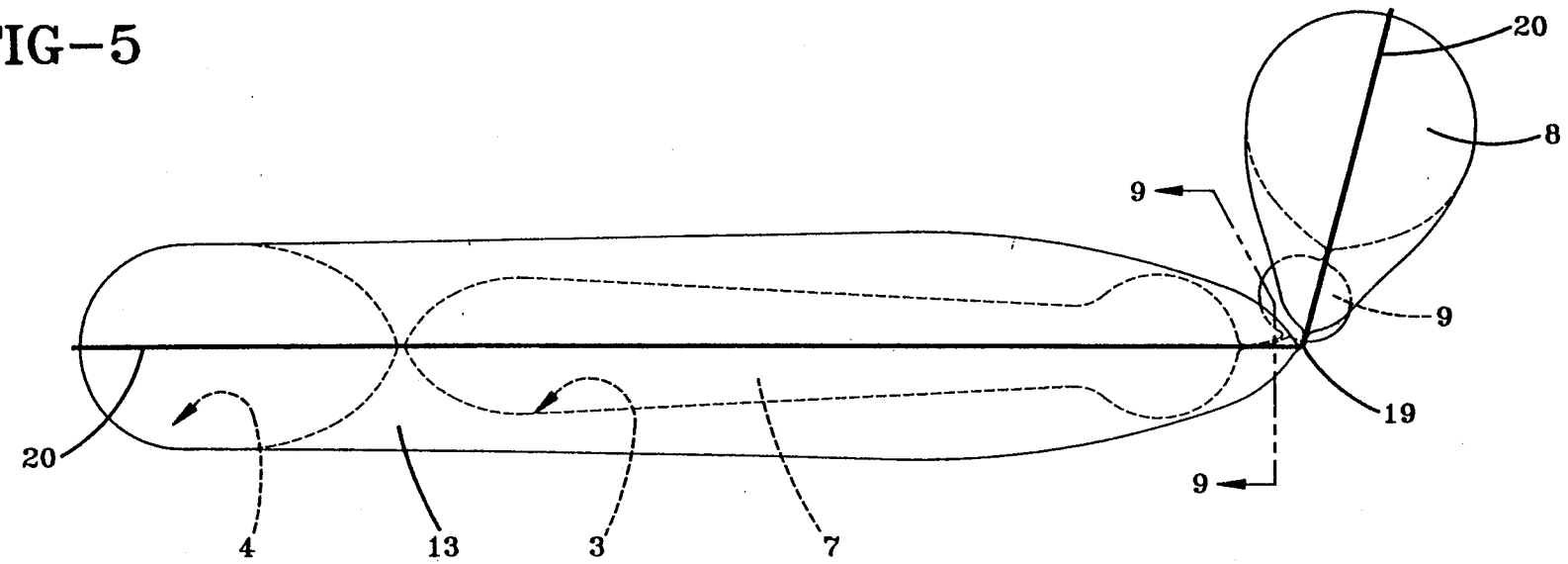
FIG. 5 is a side elevational view of the device.
Figure 8:
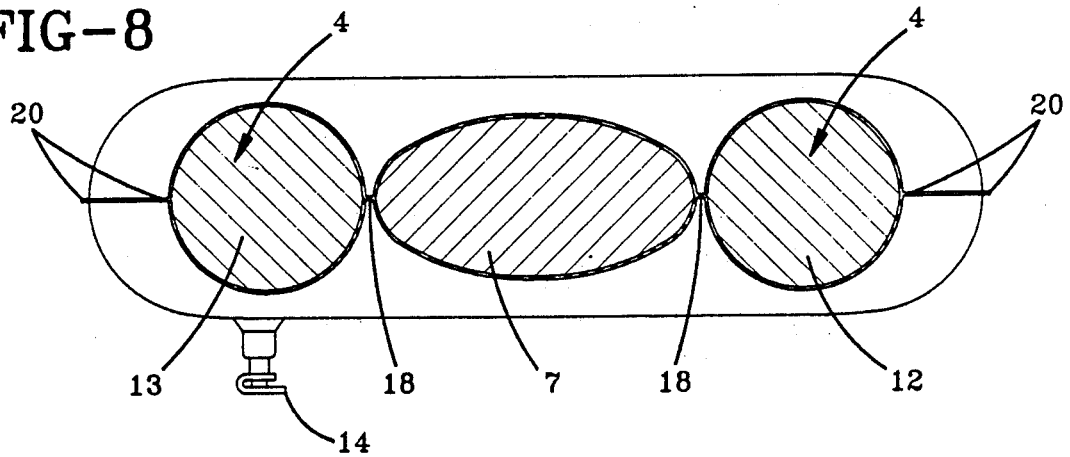
FIG. 8 is a vertical sectional view taken through line 8—8 of FIG. 3.
Figure 9:
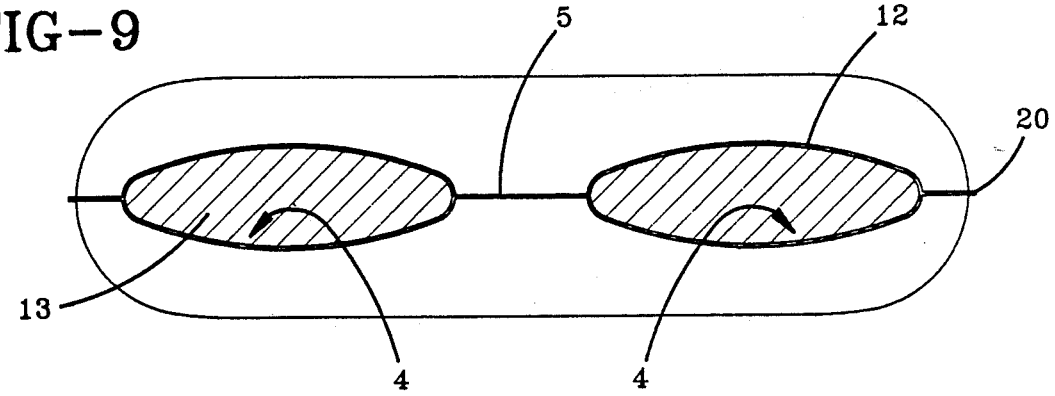
FIG. 9 is a vertical sectional view taken through line 9—9 of FIG. 5.

Each of the several chambers has an inlet valve member 14 and 15 preferably mounted on the non-bodily supporting side of the device for inflating the device either by mouth or by a suitable pump. The two chambers are preferably inflated to essentially equal low pressure varying from about ½ to 5 pounds per square inch, the valves permitting entry and retention of the retained gas such as air. The valves are comprised of essentially well-known types of valving structures which permit ready entry of the gas for inflation and deflation of the device such as by pinching the valve to allow egress of the pressurized gas. During inflation, valves 14 and 15 extend outwardly from the surface of the device as shown in FIG. 8 and after inflation are pushed inwardly into the device so as to assume a recessed position as shown particularly in FIG. 11.

The manner of use of device 1 is shown particularly in FIGS. 12 and 13. A user 25 lies upon the device, preferably with the knees in a partially bent position, with the buttocks being supported principally by inflated portion 9, and with the tailbone of the user generally aligning within uninflated base portion 5. These regions provide a pelvic recess area for the individual. The user's back, and in particular, the muscled areas 26 extending along the spine, are supported by and extend along leg portions 12 and 13 of chamber 4, with the upper back and shoulder area being supported by curved end portion 11 of chamber 4. Cross-over portion 8 will support the lower portion of the buttocks and hip area. Furthermore, the spine of user 25 lies along and is supported out of contact with the supporting surface or floor, by vertical leg portion 7 which is slightly recessed beneath the top surface of legs 12 and 13 of U-shaped channel 4.

Upon the individual starting to raise upwardly to an inclined position when performing a sit-up as shown in FIG. 13, pressure will be exerted by the buttocks against the lower ends of legs 12 and 13 of U-shaped chamber 4, which will force the air upwardly in the direction of arrows A. This air movement will have a lifting effect, such as shown by arrows B, against the users back assisting the user during the sit-up exercise, to avoid possible strain on the user's back. There also will be some air flow moving from cross-over portion 8 into inflated area 9 and into the lower area of vertical leg portion 7. This will avoid the user's tailbone from contacting the supporting surface or floor.

Upon the user moving from the inclined position of FIG. 13 back to the reclined position of FIG. 12, the air will move from the upper areas of leg portions 12 and 13 and curved end portion 11, toward the bottom areas of the leg portions as shown by arrows C. This air movement will tend to support the buttocks area of the user preventing it from contacting the supporting surface. Thus, during the sit-up upward movement, the movement of air principally within U-shaped chamber 4, provides an assist to the user as well as providing a cushioning effect to the buttocks and hip areas during the reclining motion.

By inflating the chambers to different pressures, the effectiveness of the assist can be varied. For example, a higher inflation pressure will provide a greater assist force on the user making the sit-up easier, than if a low inflation pressure is used which will make the sit-up more difficult.

Accordingly, the improved inflatable sit-up exercise device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described..

Having now described the features, discoveries and principles of the invention, the manner in which the improved inflatable sit-up exercise device is constructed and used, the characteristics of the construction, and the advantageous, new and useful results obtained; the new and useful structures, devices, elements, arrangements, parts and combination, are set forth in the appended claims.

We claim:

1. An inflatable exercise device for use by an exerciser doing sit-up type exercises to stress the exerciser's abdominal muscles, said device comprising at least one inflatable hollow chamber formed from flexible resilient thin plastic material adapted to contain a fluid medium for comfortably supporting the body of the exerciser, said inflatable hollow pressurized chamber when inflated having a T-shaped basin portion including a single axially-aligned central recessed area to support the tailbone and lumbar spine areas of the exerciser out of contact with a device supporting surface, and an inflated U-shaped area having a greater thickness than the single central recessed area and surrounding the said recessed area to support the buttocks and back muscled areas on both sides of the lumbar spine of the exerciser, and a transversely-hinged essentially uninflated portion of said device located at the pelvic area of the exerciser to provide a pelvic tilt assist to the exerciser by said inflated hollow pressurized chamber disposed on both sides of said uninflated hinged portion in performing sit-up type exercises.

2. An inflatable exercise device for use by an exerciser doing sit-up type exercises to stress the exerciser's abdominal muscles, said device comprising at least two inflatable separate hollow chambers formed from flexible resilient thin plastic material adapted to contain a fluid medium for comfortably supporting the body of the exerciser, one of said chambers being a T-shaped basin portion with an axially-aligned recessed area of lesser thickness, adapted to support the buttocks, tailbone and lumbar spine areas of the exerciser, and the other of said chambers being U-shaped and having a greater thickness and surrounding certain portions of the recessed area of the T-shaped chamber and adapted to support the buttocks and back muscled areas on both sides of the lumbar spine of the exerciser; and a transversely-hinged essentially uninflated portion of said device located at the pelvic area of the exerciser to provide a pelvic tilt assist to the exerciser by pressure changes in weight shift on said second U-shaped hollow chamber when performing sit-up type exercises.

3. The device in accordance with claim 2, wherein the said T-shaped basin portion which provides the buttocks, tailbone and lumbar spine supporting areas of said first hollow chamber are of lesser thickness in said tailbone and lumbar spine areas for comfortably supporting said body areas in their natural axial alignment with said device.

4. The device in accordance with claim 2, wherein the said first hollow chamber has a T-shaped configuration with the cross-member portion for supporting the buttocks area having a considerably greater cross-sectional thickness than the vertical leg portion of lesser thickness and having at least two longitudinally-aligned recessed areas for supporting the tailbone and lumbar spine areas of the exerciser in their natural axial alignment.

5. The device in accordance with claim 2, wherein the said second U-shaped hollow chamber provides support for said bifurcated back muscled areas of the exerciser and provides reciprocating longitudinal flow of the contained fluid medium effected by weight shifts when the exerciser moves between generally prone and sit-up positions to provide both a fluid-assist effect and a pelvic tilt effect to the exerciser.

6. The device in accordance with claim 2, wherein the said device is inflated with air at a relatively low pressure ranging from about ½ to 5 pounds per square inch.

7. The device in accordance with claim 2, wherein the said device has two separate inlet valves for inflating the said two hollow chambers.

8. The device in accordance with claim 2, wherein the first pressurized chamber supports the buttocks, tailbone and lumbar spine areas of said exerciser at a lower elevation than said second pressurized chamber which supports the back muscled areas of said exerciser at a higher elevation for providing a pelvic-assisted rotational effect between said chambers upon performance of sit-up type exercises.

9. An exercise device for use by an exerciser doing sit-up type exercises to stress the exercisers's abdominal muscles, said device comprising an inflatable thin-walled structure formed from flexible resilient plastic material having at least two separate hollow chambers each containing a fluid medium under pressure, a first pressurized chamber having a T-shaped configuration adapted to receiving and supporting the buttocks, tailbone and lumbar spine areas of the exerciser at a lower level, a second pressurized chamber having a U-shaped configuration adapted to receiving and supporting the upper and lower back muscled areas of the exerciser at a higher elevation, and an essentially uninflated hinged portion of said device located at the pelvic area between said first and second pressurized chambers to provide a pelvic tilt effect to said exerciser, said second pressurized chamber providing longitudinal reciprocating fluid flow therewithin and sit-up assist to said exerciser when weight shift occurs between the prone and upright sitting positions of the exerciser.

10. An inflatable exercise device for use by an exerciser doing sit-up type exercises to stress the exerciser's abdominal muscles, said device comprising at least two inflatable hollow chambers formed from thin flexible resilient plastic material, said hollow chambers each having individual valve means for entry and retention of a fluid medium to inflate each of said hollow chambers individually for their combinedly supporting the major weight of said exerciser, a first pressurized hollow chamber having a generally T-shaped configuration for supporting the buttocks, tailbone and lumbar spine areas of the exerciser at a lower level, a second pressurized hollow chamber having a U-shaped configuration for supporting the upper and lower back muscled areas of the exerciser at a higher level, said second chamber having a greater volume and thickness than said first chamber, and an essentially uninflated hinged portion located intermediate the two pressurized hollow chambers adjacent the pelvic area of the exerciser for providing a pelvic tilt effect upon the exerciser when shifting weight upwardly and downwardly during sit-up type exercises.

11. The device in accordance with claim 10, wherein the said exercise device is formed from two thin sheets of flexible polyvinyl material which are heat sealed (a) peripherally and at a T-shaped axially-aligned intermediate area to form the separately-inflatable two hollow chambers and (b) at a pelvic support hinged uninflatable area to provide the pelvic tilt effect between the two said pressurized hollow chambers.

12. The device in accordance with claim 10, wherein the said two hollow chambers are inflated with air at relatively low pressure to provide essentially full body support for comfortably performing sit-up type exercises and to provide a pelvic tilt effect to pneumatically assist such efforts.

13. The device in accordance with claim 10, wherein the said inflatable exercise device is formed into a one-piece body structure from two similarly-shaped thin sheets of polyvinyl material which are heat-sealed peripherally and at selected intermediate areas to form the said two T-shaped and U-shaped pressurized chambers, the said T-shaped chamber having its longer leg position extending into the said U-shaped chamber.

14. An inflatable exercise device for use by an exerciser doing sit-up type exercises to stress the exerciser's abdominal muscles, said device comprising at least one inflatable hollow chamber formed from flexible resilient thin plastic material adapted to contain a fluid medium for comfortably supporting the body of the exerciser on a supporting surface, said inflatable hollow pressurized chamber when inflated having an axially-aligned recessed area of lesser thickness to support the tailbone and lumbar spine areas of the exerciser out of contact with the device supporting surface; said hollow pressurized chamber when inflated also having a U-shaped greater thickness surrounding the said recessed area to support the buttocks and back muscled areas on both sides of the lumbar spine of the exerciser, and a transversely-hinged essentially uninflated portion of said device located at the pelvic area of the exerciser to provide a pelvic tilt assist to the exerciser by said inflated hollow pressurized chamber disposed on both sides of said uninflated hinged portion in performing sit-up type exercises, said uninflated hinged portion being located intermediate the said greater and lesser thickness portions of said hollow chamber.

* * * * *